US005141224A

United States Patent [19]

Nolde et al.

[11] Patent Number: 5,141,224

[45] Date of Patent: Aug. 25, 1992

[54] BASKETBALL RETURN DEVICE

[75] Inventors: Bart D. Nolde; Byron C. Nolde, both of Onaway; Patrick F. Miller, Midland, all of Mich.

[73] Assignee: Zingerback Manufacturing Co., Onaway, Mich.

[21] Appl. No.: 790,453

[22] Filed: Nov. 12, 1991

[51] Int. Cl.[5] ..... A63B 63/08

[52] U.S. Cl. ..... 273/1.5 A

[58] Field of Search ..... 273/1.5 R, 1.5 A, 396, 273/397; 193/2 R, 2 A, 5, 14

[56] References Cited

U.S. PATENT DOCUMENTS

| | | | |
|---|---|---|---|
| 544,928 | 8/1895 | Patterson . | |
| 1,522,957 | 1/1925 | Kennedy | 273/1.5 R |
| 1,765,269 | 6/1930 | Hatley | 273/1.5 A |
| 2,060,938 | 6/1933 | Johnson | 272/57 |
| 2,838,308 | 3/1956 | Polite | 273/1.5 |
| 2,889,149 | 6/1956 | Williams | 273/103 |
| 3,233,896 | 5/1962 | King | 273/1.5 |
| 3,544,109 | 12/1967 | Woods | 273/1.5 |
| 3,776,550 | 12/1973 | McNabb | 273/1.5 |
| 3,799,543 | 3/1974 | Steele, Jr. | 273/1.5 |
| 3,814,421 | 6/1974 | Spier, Jr. | 273/1.5 |
| 3,913,916 | 10/1975 | Martin, Jr. | 273/103 |
| 4,613,135 | 9/1986 | Rush | 273/1.5 R |
| 4,786,052 | 11/1988 | Zinger | 273/1.5 |

*Primary Examiner*—Paul E. Shapiro
*Attorney, Agent, or Firm*—Brooks & Kushman

[57] ABSTRACT

A basketball deflection device is disclosed for a basketball goal assembly. The basketball deflection device comprises a mounting section and a deflection section. The mounting section has a first end which is attachable to the basketball goal assembly, and a second end having a preformed slot therethrough. The deflection section has a first end which is insertable through the performed slot of the second end of the mounting section to removably secure the deflector section to the mounting section. A second end of the deflector section is adapted to deflect the basketball away from the basketball goal assembly when a successful shot is made. Optionally, a bolt is provided to more permanently fasten the deflector and mounting sections together.

9 Claims, 2 Drawing Sheets

BASKETBALL RETURN DEVICE

TECHNICAL FIELD

This invention relates to ball return devices, and more particularly to a return device for deflecting a basketball away from a backboard on which a basketball rim is mounted.

BACKGROUND ART

A conventional basketball goal assembly includes a backboard to which an annular rim and net are mounted. The backboard is typically held above the ground by a pole embedded in the ground, or hung from a ceiling or wall when used indoors. When a basketball passes through the rim and net of the goal assembly, the basketball frequently bounces away from the shooter. To shoot again, the shooter must retrieve the ball from whatever location to which it has moved. Thus, it is difficult for the shooter to repetitively practice from the same shooting point.

Various prior art ball return devices have addressed this problem. U.S. Pat. No. 3,233,896 issued to King on Feb. 8, 1966 and U.S. Pat. No. 3,776,550 issued to McNabb on Dec. 4, 1973, for example, provide a chute which extends in a path from a location generally at the basketball rim back to the shooter. U.S. Pat. No. 3,814,421 issued to Spier, Jr. on Jun. 4, 1974, likewise discloses a chute which is somewhat shorter than the McNabb and King devices. Such prior art devices are cumbersome, complicated, expensive, and not easily disassembled.

Other prior art ball return devices such as U.S. Pat. No. 3,799,543 issued to Steele, Jr. on Mar. 26, 1974 incorporate a suspendable deflector which is detachably mounted on the rim via a series of magnets. Such devices are relatively expensive, however, and have a limited ability to maintain the deflector in position.

U.S. Pat. No. 4,786,052 issued to Zinger on Nov. 22, 1988 discloses a one-piece basketball return device which is bolted between the backboard and the rim. Because the return device is bolted in place, its removal from the basketball goal assembly is time consuming and inconvenient.

DISCLOSURE OF THE INVENTION

It is an object of the present invention to provide an improved basketball return device comprising a mounting section having a first end attachable to a basketball goal assembly and a second end having a preformed slot therethrough, and also comprising a deflector section having a first end insertable through the preformed slot of the second end of the mounting section, and a second end adapted to deflect the basketball away from the basketball goal assembly upon a successful shot.

It is another object of the present invention to provide a basketball return device of the type described above which is easy to mount and dismount, durable, and relatively inexpensive.

Yet another object of the present invention is to provide a basketball return device of the type described above which can be removably secured by positioning the mounting section between the backboard and the rim of the basketball goal assembly and inserting the deflector section through the preformed slot in the mounting section.

In carrying out the above objects and other objects of the present invention, a basketball deflection device is provided for a basketball goal assembly, the basketball deflection device comprising a mounting section and a deflector section. The mounting section has a first end which is attachable to the basketball goal assembly, and a second end which has a preformed slot therethrough. The deflector section has a first end which is insertable through the preformed slot of the second end of the mounting section, and a second end which is adapted to deflect the basketball away from the basketball goal assembly upon the basketball being received therethrough. When the first end of the deflector section is inserted through the preformed slot of the second end of the mounting section, the deflector section is removably secured to the mounting section.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

With reference to the drawings, the preferred embodiment of the present invention will be described.

Figure 1:
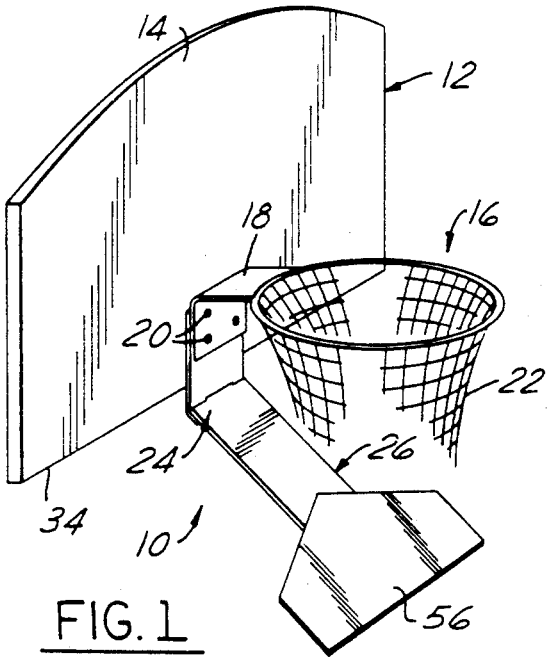
FIG. 1 is a perspective view of a typical basketball goal assembly having a basketball deflection device according to the present invention mounted thereto.

FIG. 1 shows a basketball deflection device generally designated 10 for use with a basketball goal assembly 12. The basketball goal assembly 12 includes a vertically disposed, planar backboard 14 and a forwardly extending annular rim or hoop 16 attached to the backboard 14. The rim 16 is attached to the backboard 14 by means of an angled bracket 18 which is typically welded to the rim 16 at one end and bolted to the backboard 14 at its other end by means of bolts 20. Alternative "breakaway" rim designs have equivalent mounting structures. A net 22 hangs from the rim 16, and together they are adapted to receive therethrough a basketball shot by a shooter.

Figure 2:
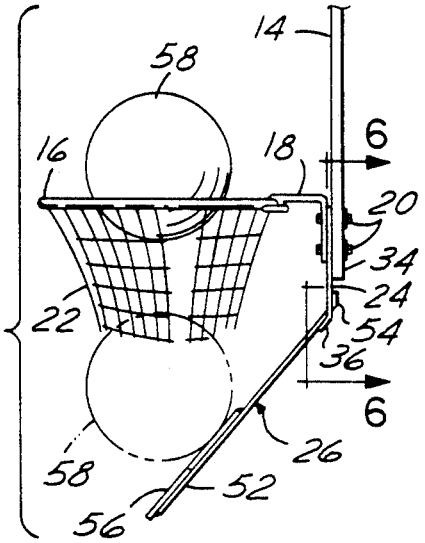
FIG. 2 is a side view of the basketball deflection device mounted on the basketball goal assembly and also illustrating the path of a basketball passing through a rim and net of the basketball goal assembly.
Figure 3:
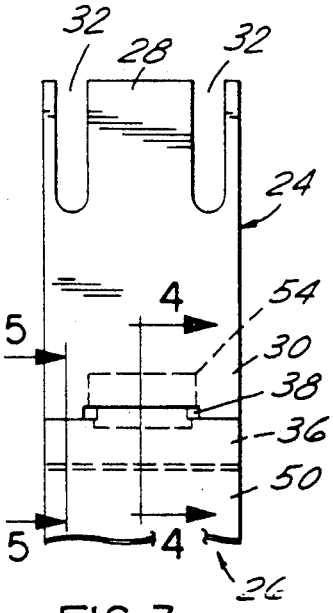
FIG. 3 is a partial front view of a mounting section and a deflector section of the basketball deflection device removably secured to each other.

As shown in FIGS. 2 and 3, the basketball deflection device 10 of the present invention comprises a mounting section 24 and a deflector section 26. The mounting section 24 has a first end 28 and a second end 30. The first end 28 of the mounting section 24 is provided with two parallel elongated slots 32, each of which is slightly wider than the diameter of the bolts 20. To attach the mounting section 24 to the basketball goal assembly 12, the first end 28 of the mounting section is placed between the backboard 12 and the bracket 18, and the elongated slots 32 are fit around the bolts 20. The bolts 20 are then tightened to secure the mounting section 24 to the basketball goal assembly 12. After being so secured, the mounting section 24 depends generally vertically from the basketball goal assembly 12 such that the second end 30 of the mounting section 24 extends beyond the bottom 3 of the backboard 14.

The second end 30 of the mounting section 24 includes an angled flange 36, and a preformed slot 38 located through the second end 30 generally at the point where the flange 36 angles off the remainder of the mounting section 24. Preferably, when the mounting section 24 is in place, the flange 36 extends at about a 135 degree angle from the plane defined by the backboard 14. It should be understood, however, that this angle can be varied according to preference. The slot 38 is oriented generally horizontally, and is adapted to receive the deflector section 26 as described below.

Figure 4:
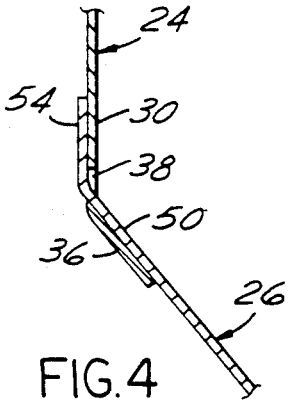
FIG. 4 is a partial cross-sectional view taken along line 4—4 of Figure.
Figure 5:
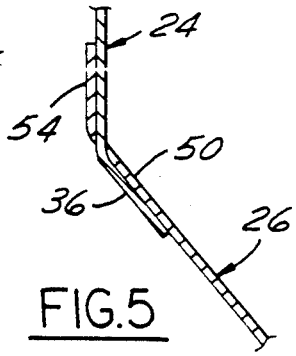
FIG. 5 is a partial cross-sectional view taken along line 5—5 of FIG. 3.
Figure 6:
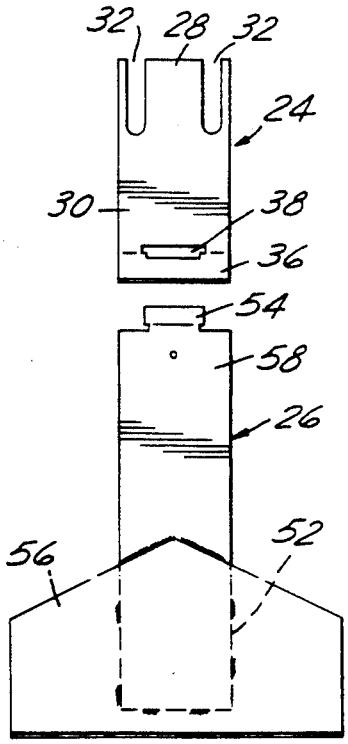
FIG. 6 is a front view of the mounting and deflector sections of the basketball deflection device detached from each other.

FIGS. 4 through 6 show that the deflector section 26 of the present invention is provided with a first end 50 and a second end 52. The first end 50 of the deflector section 26 has a tab 54 which is angled at about 135 degrees with respect to the remainder of the deflection section 26. The tab 54 is insertable through a wider upper portion of the preformed slot 38 of the second end 30 of the mounting section 24. Thereafter, the deflector section 26 is allowed to fall under its own weight, and rotates relative to the mounting section 24, until the tab 54 is biased against the back of the second end 30 of the mounting section 24 and the first end 50 of the deflector section 26 rests on the angled flange 36. At this point, the tab 54 is locked behind the narrow lower portion of the preformed slot. This removably secures deflector section 26 to the mounting section 24. When mounted in this way, the second end 52 of the deflector section 26 and a pentagon-shaped plate 56 welded or otherwise attached thereto extend generally below the vertical cylinder defined by the rim 16.

Referring again to FIG. 2, a successful shot is made when a basketball 58 passes through the rim 16 and falls through the net 22. With the basketball deflection device 10 of the present invention in place, the basketball 58 shown in phantom then impacts the pentagon-shaped plate 56. The basketball 58 is then deflected away from the basketball goal assembly 12 and back along a path generally normal to the backboard 14. Both the mounting section 24 and the deflector section 26 flex to a certain extent during impact, which reduces the speed at which the basketball 58 rebounds off the deflection device 10.

To remove the basketball deflection device 10 from the goal assembly 12, the mounting procedure is easily reversed. The deflector section 26 is simply lifted up and rotated relative to the mounting section 24 until the tab 54 can be withdrawn through the wider portion of the slot 38 in the mounting section 24. Thus, the deflector section 26 is easily installed and removed without the need for any tools. The mounting section 24 itself can be left in place during actual basketball game play, or removed entirely.

Figure 7:
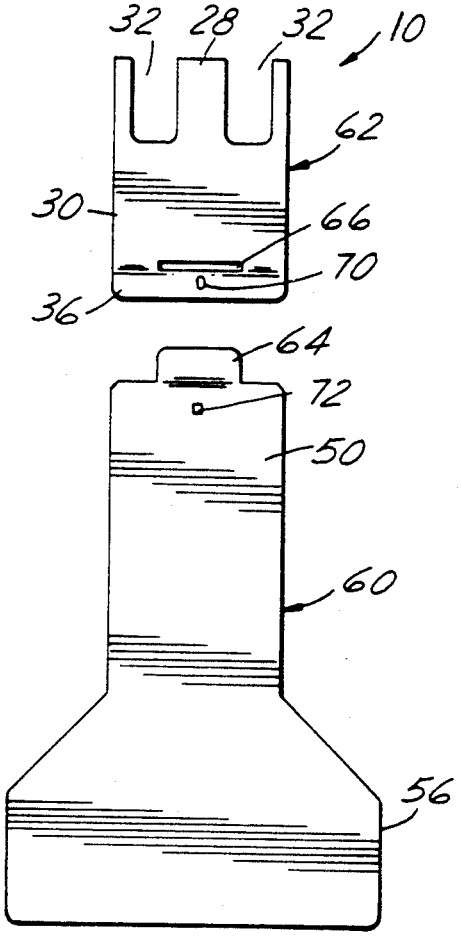
FIG. 7 is a front view of the detached mounting and deflector sections of an alternative embodiment of the basketball deflection device.
Figure 8:
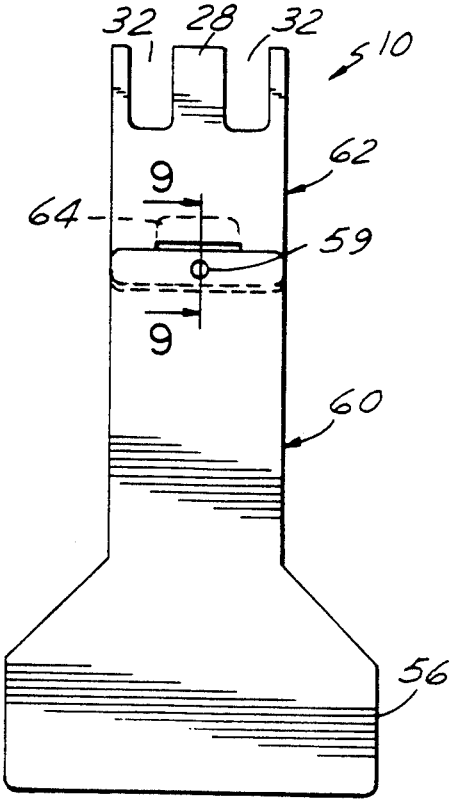
FIG. 8 is a front view of the mounting and deflector sections of the alternative embodiment removably secured to each other.
Figure 9:
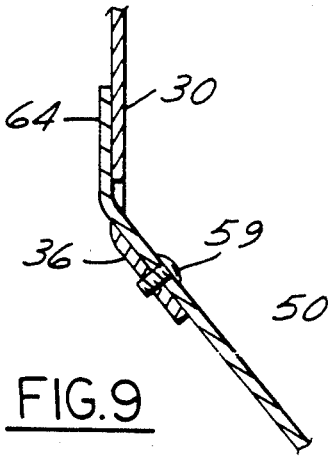
FIG. 9 is a partial cross-sectional view taken along line 9—9 of FIG. 8.

FIGS. 7-9 show an alternative embodiment of the basketball deflection device 10 including fastening means in the form of a rivet or bolt 59 to more permanently secure the deflector section 60 to the mounting section 62. The tab 64 of the deflector section 60 is not notched as in the previous embodiment, nor is the slot 66 notched. The sections 60 and 62 are instead removably secured together by the bolt 59 which extends through matching holes 70 and 72 in the mounting and deflector sections, respectively. A nut (not shown) can be provided to hold the fastener 59 in place if a threaded fastener is used. It will be appreciated, however, that the notched tab and slot of the first embodiment can be combined with the bolt 59 if desired.

It should be understood that while the forms of the invention herein shown and described constitute preferred embodiments of the invention, they are not intended to illustrate all possible forms thereof. It also should be understood that the words used are words of description rather than limitation, and various changes may be made without departing from the spirit and scope of the invention disclosed.

What is claimed is:

1. A basketball deflection device for a basketball goal assembly, the basketball goal assembly including a backboard and a forwardly extending rim attached to the backboard for receiving therethrough a basketball shot by a shooter, the basketball deflection device comprising:

a mounting section having a first end and a second end, the first end being attachable to the basketball goal assembly;

a deflector section having a first end and a second end, and means for removably suspending said deflector section from said mounting section with the second end of the deflector section unsupported in a position under the rim, said means comprising a preformed slot through the second end of said mounting section and the first end of said deflector section being insertable through the preformed slot, whereby the second end of said deflector section is adapted to deflect the basketball away from the basketball goal assembly upon the basketball being received through the rim.

2. The basketball deflection device of claim 1 further comprising fastening means to secure the deflector section to the mounting section.

3. The basketball deflection device of claim 2 wherein the fastening means comprises a bolt.

4. The basketball deflection device of claim 1 wherein the mounting section depends generally vertically from the basketball goal assembly.

5. The basketball deflection device of claim 1 wherein the performed slot is oriented generally horizontally.

6. The basketball deflection device of claim 1 wherein the second end of the deflector section is adapted to deflect the basketball away from the basketball goal assembly and toward the shooter.

7. A basketball goal assembly comprising:

a backboard;

a forwardly extending rim attached to the backboard for receiving therethrough a basketball shot by a shooter; and a basketball deflection device including:

a mounting section having a first end and a second end, the first end being attachable to the basketball goal assembly;

a deflector section having a first end and a second end, and means for removably suspending said deflector section from said mounting section with the second end of the deflector section unsupported in a position under the rim, said means comprising a preformed slot through the second end of said mounting section and the first end of said deflector section being insertable through the preformed slot, whereby the second end of said deflector section is adapted to deflect the basketball away from the basketball goal assembly upon the basketball being received through the rim.

8. The basketball goal assembly of claim 7 further comprising fastening means to secure the deflector section to the mounting section.

9. The basketball goal assembly of claim 8 wherein the fastening means comprises a bolt.

* * * * *